US006971168B2

(12) United States Patent
Bianchi

(10) Patent No.: US 6,971,168 B2
(45) Date of Patent: Dec. 6, 2005

(54) COMPRESSOR VALVE PLATE

(75) Inventor: Vittorio Bianchi, Ferrera di Varese (IT)

(73) Assignee: Embraco Europe S.r.l., Turin (IT)

( * ) Notice: Subject to any disclaimer, the term of this patent is extended or adjusted under 35 U.S.C. 154(b) by 540 days.

(21) Appl. No.: 10/204,469

(22) PCT Filed: Feb. 20, 2001

(86) PCT No.: PCT/EP01/01918

§ 371 (c)(1),
(2), (4) Date: Aug. 21, 2002

(87) PCT Pub. No.: WO01/63126

PCT Pub. Date: Aug. 30, 2001

(65) Prior Publication Data

US 2003/0010167 A1 Jan. 16, 2003

(30) Foreign Application Priority Data

Feb. 22, 2000 (IT) ..... TO2000A0161

(51) Int. Cl.[7] ..... F04B 39/10

(52) U.S. Cl. ..... 29/888.44; 29/888.41; 29/888.4; 417/451; 417/565

(58) Field of Search ..... 29/888.3, 888.4, 29/888.41, 888.44; 417/451, 565

(56) References Cited

U.S. PATENT DOCUMENTS

| | | | | |
|---|---|---|---|---|
| 4,642,037 A | * | 2/1987 | Fritchman | 417/571 |
| 5,035,050 A | * | 7/1991 | Cowen | 29/888.02 |
| 5,328,338 A | * | 7/1994 | Hirano et al. | 417/312 |
| 6,026,721 A | | 2/2000 | Fukai | |

FOREIGN PATENT DOCUMENTS

| | | | |
|---|---|---|---|
| DE | 4039786 | * | 6/1992 |
| EP | 0 874 155 A | | 10/1998 |
| JP | 07 024 544 A | | 1/1995 |

* cited by examiner

*Primary Examiner*—Eric Compton
(74) *Attorney, Agent, or Firm*—Sughrue Mion, PLLC

(57) ABSTRACT

A method of manufacturing a compressor valve plate (36) comprises at least the following steps in succession: blanking of a blank of the plate (36) from a steel sheet of suitable thickness, punching holes corresponding to the output and intake openings, the hole corresponding to the output opening being a preliminary hole (48*a*) having a diameter larger than the final diameter of this opening (48), forming, by coining, a depression (42) for housing an output valve-closure blade (54), with the depth of the depression increasing towards the end of the depression which corresponds to the preliminary hole (48*a*), in a manner such that, during the coining, at least some of the material of the blank creeps towards the preliminary hole, partially filling it, calibrating the output opening (48) to the final diameter by punching, and coining an annular projection (50) around the calibrated output opening (48) to define a valve seat for the output closure blade.

6 Claims, 4 Drawing Sheets

COMPRESSOR VALVE PLATE

This is a National stage entry under 35 U.S.C. § 371 of Application No. PCT/EP01/01918 filed Feb. 20, 2001, the above noted prior applications are all hereby incorporated by reference.

BACKGROUND OF THE INVENTION

The present invention relates to automatic valves used in compressors, particularly in hermetic motor-driven compressors for refrigerators and the like.

In these compressors, a valve plate having an intake opening and an output opening is clamped between the cylinder and the manifold head. A respective closure element constituted by an elongate, resiliently flexible metal blade is associated with each of the openings.

One end of each of these blades cooperates with the respective opening and the other end is fixed to the plate. The closure blade of the output valve is fixed to the face of the plate remote from the piston and facing towards the head. This blade bends towards the head, moving away from the output opening when the piston expels the fluid from the cylinder.

During the intake and compression of the fluid, the closure blade of the output valve is fitted against an annular projection which surrounds the output opening.

Any measure for improving the performance of a motor-driven compressor for refrigerators and the like, with a consequent, even small, saving in electrical energy, is welcome.

One of these measures consists in reducing as far as possible the so-called clearance volume, that is, the space existing between the valve plate and the piston.

Part of this clearance volume is formed by the output opening which always remains in communication with the interior of the cylinder, given that the respective closure element closes it on the face of the valve plate facing towards the output manifold head.

SUMMARY OF THE INVENTION

It is therefore advantageous to shorten the axial length of the output opening as much as possible. This can be achieved by the formation, in the outer face of the plate, of a depression in which the output opening opens and in which the output closure blade is housed. An example of this solution is given by the document U.S. Pat. No. 2,647,683.

This depression can be produced by coining with a flat punch which forms the depression with the same depth throughout.

The preamble to claim 1 takes account of this prior art.

However, the known technique has the following disadvantages:

- coining with a flat punch requires a large coining force since all of the material of the depression is made to creep at the same time,
- owing to the large forces involved, the coining punch wears very quickly.

The main object of the invention is to provide a method which eliminates this disadvantage.

According to the invention, this object is achieved by means of a method as claimed.

By virtue of the concept of the invention, the punch which performs the coining of the depression for housing the output closure blade is pressed into the material of the valve plate progressively with relatively small coining forces and hence with little wear, causing this material to creep predominantly into the region in which the output opening is disposed. This is in fact the only region in which it is advantageous to reduce the thickness of the valve plate in order to reduce the axial length of the output opening as far as possible.

As claimed in claim 2, this operation can preferably be performed in successive steps.

After the or each coining of the depression, the metal which has spread into the hole of the output opening by creeping is removed by a punching operation to produce a calibrated output opening.

The invention also relates to a valve plate produced by the method claimed, a valve unit comprising a valve plate produced by the method, as well as a compressor, particularly for refrigerating machines, which comprises the said valve plate or the said valve unit.

BRIEF DESCRIPTION OF THE DRAWINGS

The invention will become clearer from a reading of the following detailed description, given with reference to the appended drawings, provided by way of non-limiting example, in which.

DETAILED DESCRIPTION OF THE INVENTION

Figure 1:
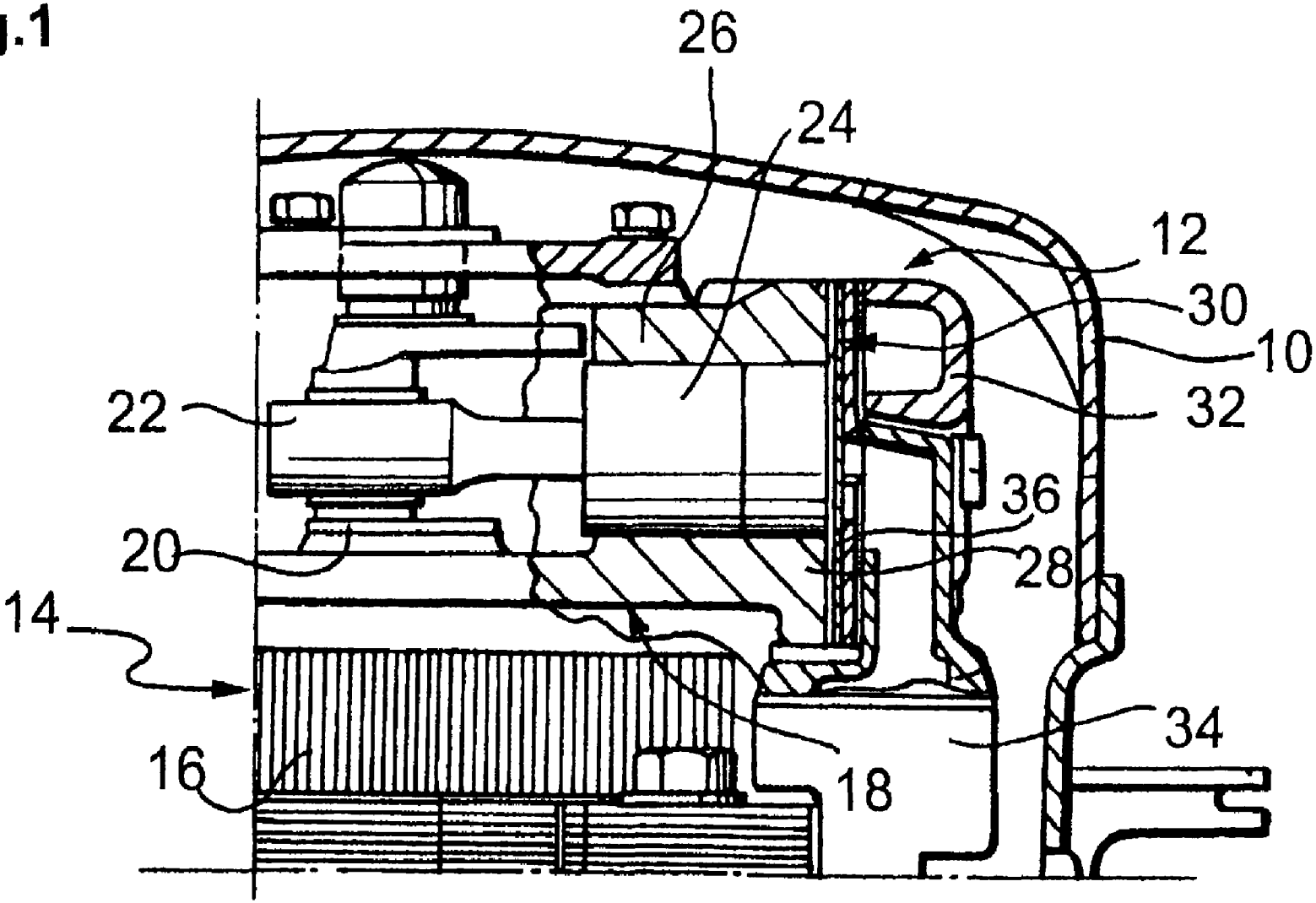
FIG. 1 is a partially-sectioned, partial elevational view of a hermetic compressor for refrigerators and the like, incorporating a valve unit according to the invention.

With reference to FIG. 1, a hermetic motor-driven compressor comprises a hermetic casing 10 in which the actual motor-driven compressor, generally indicated 12, is housed.

The motor-driven compressor 12 comprises an electric motor 14 with a stator assembly 16 suspended in the casing 10.

The housing 18 of a positive-displacement compressor is fixed to the upper portion of the stator assembly 16.

A crankshaft 20 is supported rotatably in the housing 18 and a connecting rod 22 is connected thereto. The connecting rod 22 in turn is coupled to a horizontal piston 24 slidable in a cylinder 26 formed in the housing 18.

The cylinder 26 terminates in a head end constituted by a flange 28 having a substantially square shape in plan.

A head unit or valve unit 30, which will be referred to further below, is fixed to the flange 28.

An output manifold head 32 and an intake silencer 34 are associated with the valve unit 30.

Figure 3:
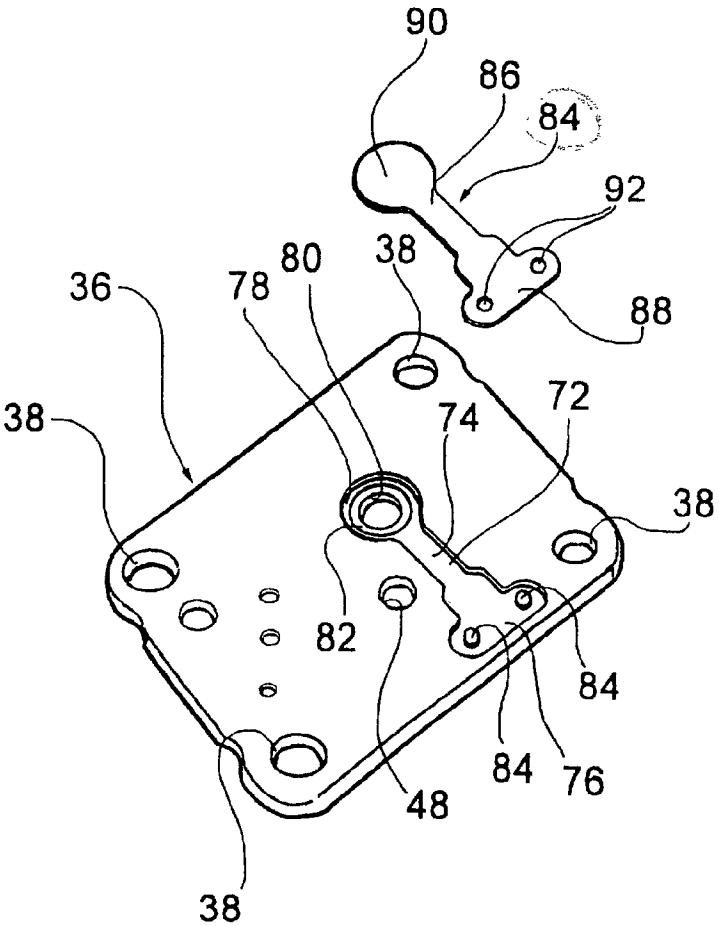
FIG. 3 is an exploded, perspective view of the same valve unit viewed from the side facing towards the cylinder of the compressor.
Figure 2:
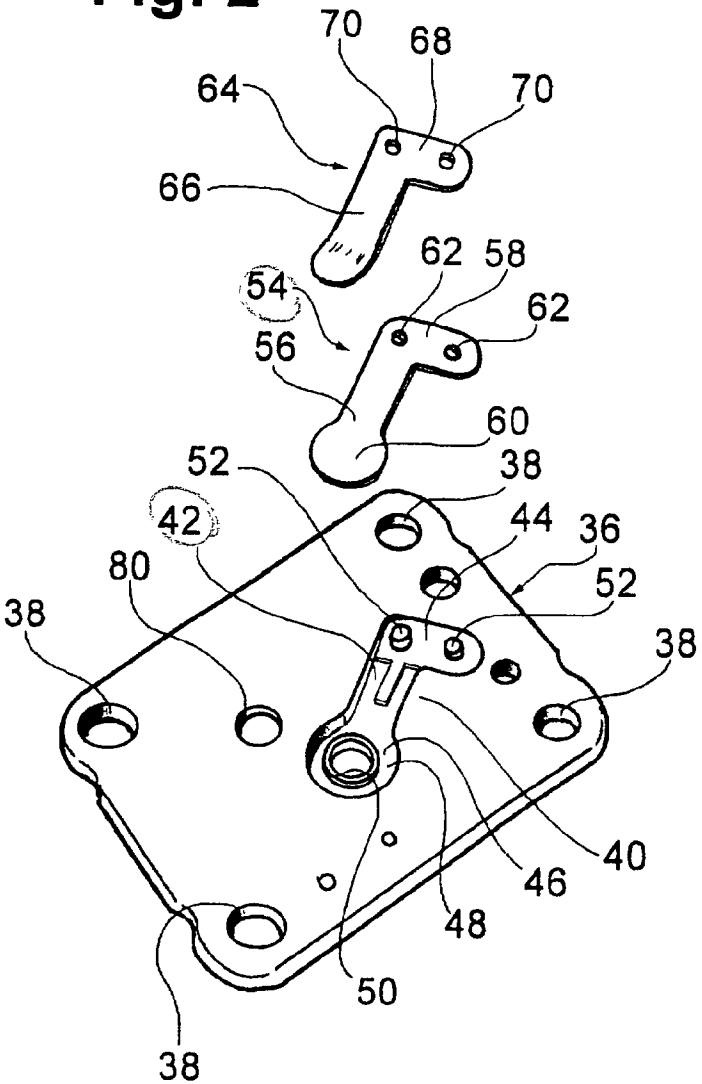
FIG. 2 is an exploded, perspective view of the valve unit of the compressor viewed from the side facing towards the output manifold head of the compressor.

With reference to FIGS. 2 and 3, the valve unit 30 of FIG. 1 comprises, basically, a square valve plate 36 made of thick steel plate.

Through-holes 38 are punched in the four corners of the plate 36 for its fixing, by means of screws, to the flange 28 of the cylinder 26, together with the output manifold head 32 (FIG. 1).

The holes 38 may be punched separately, or simultaneously with one of the punching operations which will be referred to further below.

With reference to FIG. 2, a depression 40 with a substantially L-shaped profile comprising a longer arm 42 and a shorter arm 44 is formed in the face of the plate 36 which is to face towards the output manifold head 32 of FIG. 1.

An end portion 46 of the longer arm 42 remote from the smaller arm 44 is enlarged, with a substantially circular shape.

An output through-opening 48, also visible in FIG. 3, opens in the base of this end portion 46. The output opening 48 is surrounded by an annular projection 50 which projects from the base of the enlarged portion 46.

A pair of bosses 52, the function of which will be explained below, projects from the base of the shorter arm 44.

The depression 40 houses an output closure blade 54 having an L-shape substantially corresponding to that of the depression 40 and comprising a longer arm 56 and a shorter arm 58.

An end portion 60 of the longer arm 56 remote from the shorter arm 58 is enlarged with a substantially disk-like shape to constitute an actual closure element for cooperating with the annular projection 50.

A pair of holes 62 corresponding to the bosses 52 is formed in the shorter arm 58.

The output closure blade 54 is covered by a travel limiter 64 which is also substantially L-shaped with a longer arm 66 and a shorter arm 68.

A pair of holes 70 corresponding to the holes 62 of the closure blade 54 and to the bosses 52 is formed in the shorter arm 68.

In the assembled condition, the shorter arm 58 of the blade 54 and the shorter arm 68 of the limiter 64 are held firmly in the shorter arm 44 of the depression 40 by virtue of the fact that the bosses 52 are fitted in the holes 62 and 70 and are upset like rivets onto the shorter arm of the limiter 64.

With reference to FIG. 3, a substantially T-shaped shallow depression 72 comprising a longitudinal arm 74 and a transverse arm 76 is formed in the face of the plate 36 facing the cylinder 26 of FIG. 1.

An end portion 78 of the longitudinal arm 76 is enlarged, with a substantially circular shape.

An intake through-opening 80, also visible in FIG. 2, opens in this end portion 78.

The opening 80 is also surrounded by an annular projection 82.

A pair of bosses 84 projects from the base of the transverse arm 76.

The depression 74 houses an intake closure blade 84 having a T-shaped profile corresponding to that of the depression 74 and comprising a longitudinal arm 86 and a transverse arm 88.

An end portion 90 of the longitudinal arm 86 remote from the transverse arm 88 is enlarged with a substantially circular shape and cooperates with the annular projection 82, as a closure element.

The transverse arm 88 has a pair of holes 92 in which the bosses 84 are fitted.

The bosses 84 are upset like rivets onto the transverse arm 88 in order to restrain the intake closure blade 84 firmly.

Reference will now be made to FIGS. 4 to 11 to describe the processing to which the plate 36 is subjected in order to form the depression 40 of the output valve as well as, preferably, the bosses 52 of FIG. 2 and the bosses 84 of FIG. 3.

In all of FIGS. 4 to 9 and 11, a support surface, which may not be the same in all of the operations that will be described, is conventionally indicated 94.

The steps of the blanking of a blank of the plate 36 from a steel sheet, of the punching of its corner holes 38 and of its intake opening 80, and of the coining of the depression 74 and the annular projection 82 of FIG. 3 for the intake valve will not be described since they are conventional.

Figure 4:
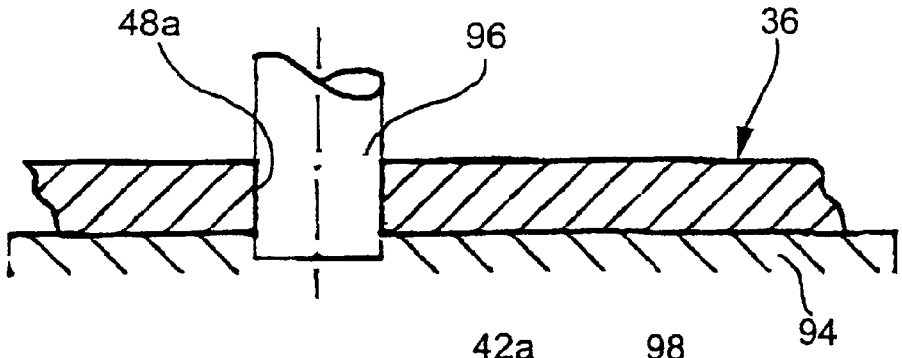
FIGS. 4 to 9 are schematic partial sections of a valve plate of the unit of FIGS. 2 and 3, showing successive steps of the processing of the plate.

In FIG. 4, a punch 96 forms, by punching in the plate 36, a preliminary hole 48*a* corresponding to the output opening 48 but having a diameter larger than the final diameter of this opening.

Figure 5:
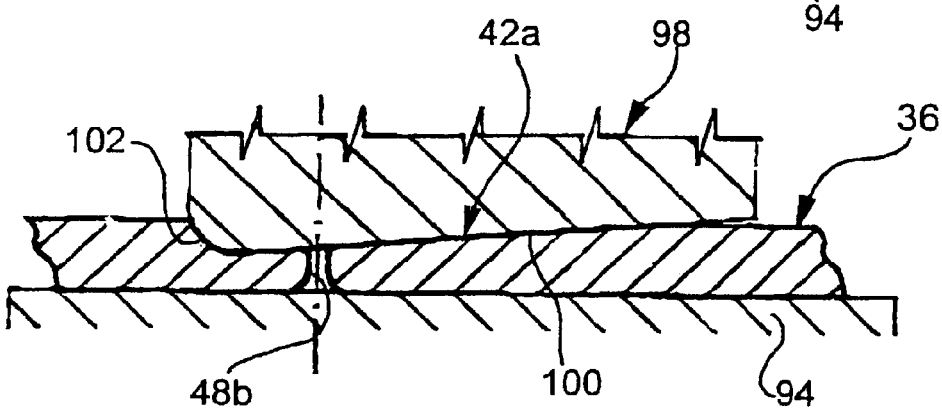

In FIG. 5, a coining punch, indicated 98, has an active surface 100 which is inclined to the support surface 94 with a slope converging towards the already-punched hole 48*a* (FIG. 4).

The flat active surface 100 terminates in an arcuate active surface 102 at an end corresponding to the hole of the output opening.

A first coining of the depression 42, indicated 42*a* in FIG. 5, is performed with the punch 98, conferring on the depression a depth which increases from the end remote from preliminary hole 48*a* of FIG. 4 (that is, corresponding to the shorter arm 44 of FIG. 2).

The first coining operation of FIG. 5 causes the material of the plate 36 to creep, as a result of which this material partially spreads into the preliminary hole and makes it smaller, more or less as shown at 48*b* in FIG. 5.

Figure 6:
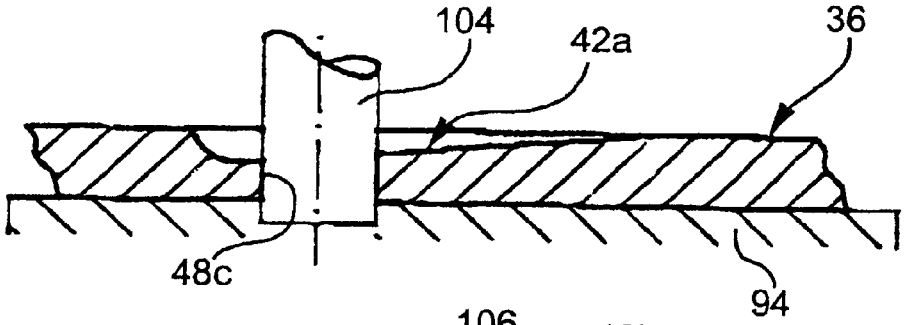

In FIG. 6, a second punch 104 performs a second punching of the preliminary hole 48*b* of FIG. 5 which brings its diameter substantially back to the value achieved in the punching step of FIG. 4, as shown at 48*c*.

In FIG. 6, the depression is again indicated 42*a*.

Figure 7:
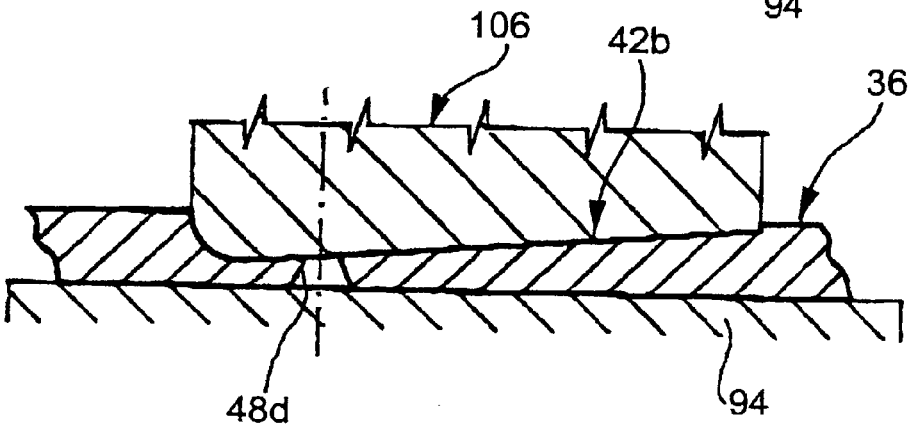

In FIG. 7, a second coining of the depression, now indicated 42*b*, is performed by means of a second coining punch 106 of a shape substantially identical to that of the punch 98 of FIG. 5.

In this case also, the material of the plate 36 is displaced by creeping and partially spreads into the hole 48*c* of FIG. 6, as indicated at 48*d*.

Figure 8:
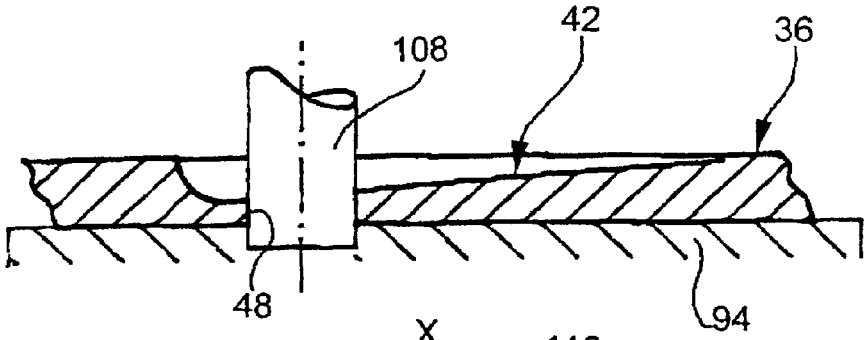

During the step of FIG. 8, a third punch 108 performs a third, final calibrating punching of the preliminary hole to the diameter of the output opening, now indicated 48.

As can already be seen in FIG. 8, by virtue of the formation of the depression 42, the finished output opening 48 has an axial length equal to less than half of the thickness of the plate 36.

Figure 9:
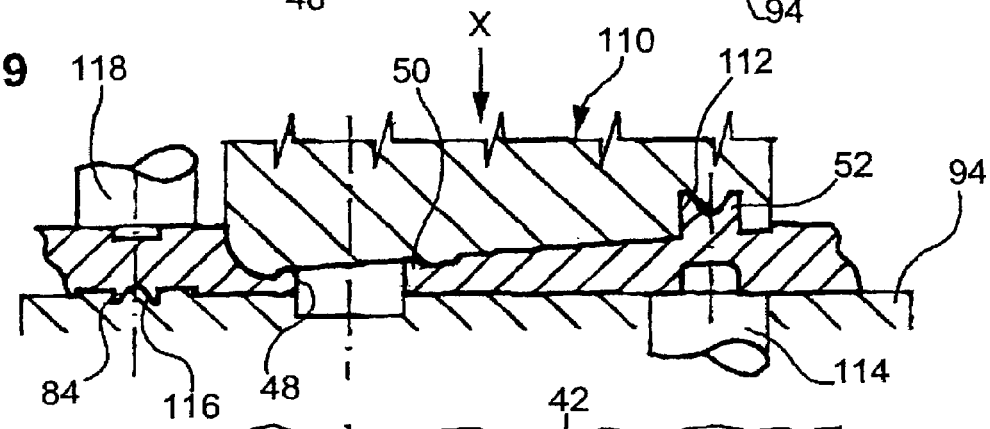

In FIG. 9, a further coining punch 110 forms the annular projection 50 of FIG. 2 around the opening 48.

Figure 10:
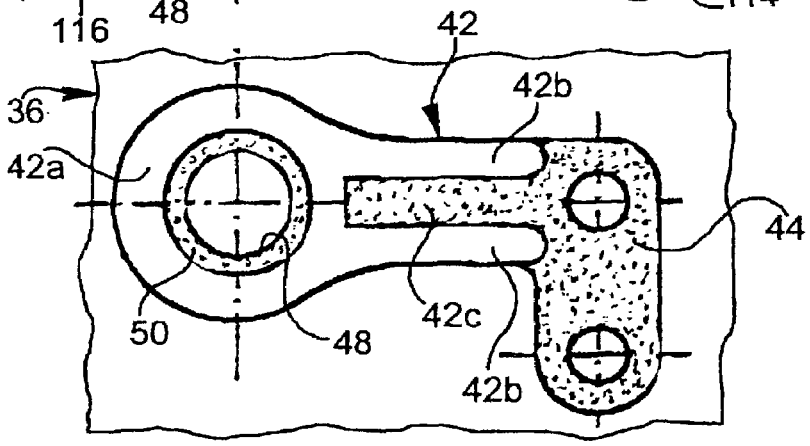
FIG. 10 is a partial plan view taken on the arrow X of FIG. 9, showing the region of the valve plate in which the depression for the output valve has been produced during the step of FIG. 9.

The configuration of the punch 110 is such as to deform the depression 42 in accordance with the configuration shown in FIG. 10, in which the projection is again indicated 50.

The base of the depression 42 is deformed, during the third coining, both in a region 42*a* surrounding the annular projection 50 and in lateral regions 42*b*. These lateral regions 42*a* extend towards the shallower end of the depression 42 which corresponds to the region of the fixing of the output closure blade 54 of FIG. 2, that is, to the shorter arm 44.

However, the surfaces of the projection 50, of the fixing region 44, and of a central strip 42*c* of the base of the depression disposed between the lateral regions 42*b* are left in a common inclined plane by the punch 110.

The central strip 42*c* is separated from the projection 50 and is connected to the fixing region or shorter arm 44.

The projecting surfaces thus produced, which are shown by speckling in FIG. 10, form part of an inclined plane on which the output closure blade 54 of FIG. 2 bears when the output valve is closed.

The punch 110 preferably but not necessarily has a shaped recess 112 which, in cooperation with a counter-punch 114, forms the two bosses 52 for the fixing of the output closure blade 54.

FIG. 9 also shows a recess 116 in the support surface 94 for cooperating with a punch 118 to form the bosses 84 for the fixing of the intake closure blade 84 (FIG. 3).

The bosses 84 may also be formed separately from the coining operation of FIG. 9.

Figure 11:
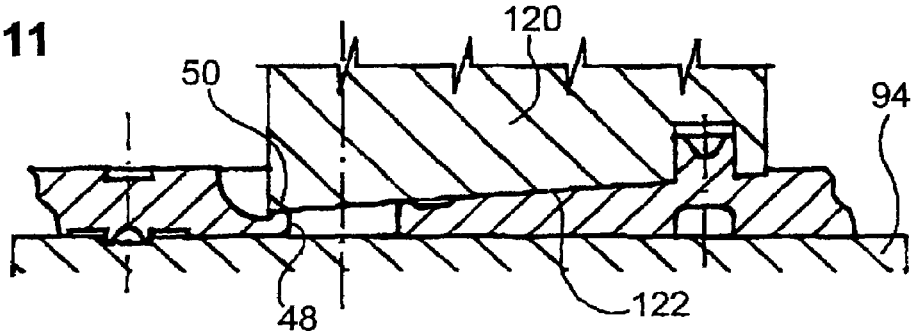
FIG. 11 is a section similar to that of FIGS. 4 to 9, showing a last step of the processing of the valve plate.

In FIG. 11, a further punch 120 with an active surface 122 inclined in the same manner as those of the punches 98, 106, 110, performs a light final finishing coining both of the projecting regions 44 and 42*c* of the depression 42 and of the annular projection 50, leaving the already finished output opening 48 unchanged.

In a simpler embodiment of the method, the processing of the valve plate 36 could comprise a single step such as that of FIG. 5 for the coining of the depression, and a single subsequent step such as that of FIG. 8 for the calibration of the output opening 48.

What is claimed is:

1. A method of manufacturing a valve plate to be interposed between the cylinder and the output manifold head of a compressor, which plate (36) has a pair of openings, that is, an output opening (48) and an intake opening (80) for cooperating, respectively, with an elongate, resilient output closure blade (54) and with an elongate, resilient intake closure blade (84), which are situated on opposite faces of the plate and each of which has one end cooperating with the respective opening and another end fixed to the plate, and in which plate (36) a depression (42) is formed at least in the face which is to face towards the compressor head, the depression (42) having a profile shape which substantially corresponds to that of the output closure blade (54) and in the base of which the output opening opens, towards one end of the depression (48), characterized in that the method also comprises at least the following steps in succession:

blanking a blank of the plate (36) from a steel sheet of suitable thickness, punching holes corresponding to the output and intake openings, the hole corresponding to the output opening being a preliminary hole (48*a*) having a diameter larger than the final diameter of this opening (48), forming, by coining, the depression (42) for housing the output closure blade (54), with the depth of the depression increasing towards the end of the depression which corresponds to the preliminary hole (48*a*), in a manner such that, during the coining, at least some of the material of the blank creeps towards the preliminary hole, partially filling it, calibrating the output opening (48) to the final diameter by punching, and coining an annular projection (50) around the calibrated output opening (48) to define a valve seat for the output closure blade (54).

2. A method according to claim 1, characterized that the method also comprises, in succession, a first punching of the preliminary hole (48*a*), a first coining of the depression (42*a*), a second punching of the preliminary hole (48*b*), a second coining of the depression (42*b*), a third, final calibration punching of the preliminary hole to the diameter of the output opening (48), a third coining of the depression in which the annular projection (50) is formed around the calibrated output opening (48), and a final finishing coining both of the depression (42) and of the annular projection (50).

3. A method according to claim 2, characterized in that, during the third coining, the base of the depression is deformed both in a region (42*a*) surrounding the annular projection (50) and in lateral regions which extend towards the shallower end of the depression which corresponds to the region (44) of fixing of the blade, but the surfaces of the projection (50), of the fixing region (44), and of a central strip (42*c*) of the base of the depression disposed between the lateral regions (42*b*), separated from the projection (50) and connected to the fixing region (44), are left in a common inclined plane, and in that the final finishing coining is performed solely on the surfaces of the annular projection (50) of the central strip (42*c*) and of the fixing region (44).

4. A method according to claim 1, characterized in that the method also comprises a step for the forming of a pair of bosses (52) situated at the shallower end (44) of the depression (42), for the subsequent fixing of the corresponding end (58) of the output closure blade (54) by upsetting of the bosses.

5. A method according to claim 4, characterized in that the method also comprises a step for forming, on the face of the plate (36) remote from the face on which the depression (42) is coined, a pair of bosses (84) for the subsequent fixing of the corresponding end (88) of the intake closure blade (84) by upsetting of the bosses.

6. A method according to claim 2, characterized in that, performed simultaneously with the third coining step, are an operation for the forming of a pair of bosses (52) situated at the shallower end of the depression (42) for the subsequent fixing of the corresponding end (58) of the output closure blade (54) by upsetting of the bosses, and an operation for forming, on the face of the plate (36) remote from the face on which the depression (42) is coined, a pair of bosses (84) for the subsequent fixing of the corresponding end (88) of the intake closure blade (84) by upsetting of the bosses.

* * * * *